US005278762A

United States Patent [19]

Kawamura

[11] Patent Number: 5,278,762

[45] Date of Patent: Jan. 11, 1994

[54] ENGINE CONTROL APPARATUS USING EXHAUST GAS TEMPERATURE TO CONTROL FUEL MIXTURE AND SPARK TIMING

[75] Inventor: Takeshi Kawamura, Kanagawa, Japan

[73] Assignee: Nissan Motor Company, Limited, Japan

[21] Appl. No.: 670,787

[22] Filed: Mar. 19, 1991

[30] Foreign Application Priority Data

Mar. 22, 1990 [JP] Japan ..... 2-69751

[51] Int. Cl.[5] ..... F02M 51/00

[52] U.S. Cl. ..... 364/431.05; 123/417; 123/419; 123/478; 123/676; 364/431.08

[58] Field of Search ..... 364/431.05, 431.06, 364/431.07, 431.08; 123/417, 418, 419, 676, 478, 416

[56] References Cited

U.S. PATENT DOCUMENTS

| | | | |
|---|---|---|---|
| 4,365,299 | 12/1982 | Kondo et al. | 364/431.06 |
| 4,389,994 | 6/1983 | Denz et al. | 123/478 |
| 4,433,654 | 2/1984 | Yokooku | 123/425 |
| 4,493,303 | 1/1985 | Thompson et al. | 123/357 |
| 4,624,229 | 11/1986 | Matekunas | 123/425 |
| 4,658,790 | 4/1987 | Kitahara | 123/440 |
| 4,725,955 | 2/1988 | Kobayashi et al. | 364/431.05 |
| 4,776,943 | 10/1988 | Kitahara | 204/427 |
| 4,825,836 | 5/1989 | Hirose | 123/478 |
| 4,846,129 | 7/1989 | Noble | 123/425 |

FOREIGN PATENT DOCUMENTS

| | | |
|---|---|---|
| 60-19939 | 2/1985 | Japan . |
| 61-55340 | 3/1986 | Japan . |
| 63-41634 | 2/1988 | Japan . |

OTHER PUBLICATIONS

Schwarz et al., "Steurung der Einspritzung und Zündung von Ottomotoren mit Hilfe der digitalen Motorelektronik MOTRONIC," *Bosch Tech. Berichte*, vol. 7 (1981)3, pp. 139-151.

*Primary Examiner*—Gary Chin
*Assistant Examiner*—Collin W. Park
*Attorney, Agent, or Firm*—Lowe, Price, LeBlanc & Becker

[57] ABSTRACT

An engine control apparatus for changing the air/fuel ratio of an air-fuel mixture supplied to the engine to a richer value each time the exhaust gas temperature exceeds a target value while the engine is operating at high-speed and high-load conditions. During the air/fuel ratio control, the timing of the sparks supplied to the engine is changed, in relation to the changed air/fuel ratio, to retain the engine output torque at a uniform value.

1 Claim, 5 Drawing Sheets

ENGINE CONTROL APPARATUS USING EXHAUST GAS TEMPERATURE TO CONTROL FUEL MIXTURE AND SPARK TIMING

BACKGROUND OF THE INVENTION

This invention related to an engine control apparatus and, more particularly, to an engine control apparatus which can provide improved fuel economy and improved exhaust performance at high-speed and high load conditions.

For example, Japanese Patent Kokai No. 63-41634 discloses a fuel delivery control apparatus for controlling the amount of fuel metered to an internal combustion engine. The fuel delivery control apparatus employs a digital computer for calculating a desired value for fuel delivery requirement in the form of fuel-injection pulse-width and timing. A basic fuel-injection pulse-width value Tp is calculated by the digital computer central processing unit as $Tp=K\times Q/N$ where K is a constant, Q is the intake air flow and N is the engine speed. The calculated basic value Tp is then corrected for various engine operating parameters. The corrected fuel-injection pulse-width value Ti is given as $$Ti=Tp\times COEF\times ALPHA+Ts$$

where ALPHA is a correction factor related to the oxygen content of the exhaust gases for providing a closed loop air/fuel ratio control, Ts is a correction factor related to the voltage of the car battery, and COEF is a correction factor given as $$COEF=1+KTw+KMR+KAS+KAI+KFUEL+.$$
$$\cdot\cdot$$

where KTw is a correction factor decreasing as the engine coolant temperature increases, KMR is a correction factor related to a desired air/fuel ratio, KAS is a correction factor for providing fuel enrichment control when the engine is cranking, KAI is a correction factor for providing fuel enrichment control when the engine is idling, and KFUEL is a correction factor for providing fuel enrichment control when the engine is accelerating. The calculated values for fuel-injection pulse width and fuel-injection timing are transferred to a fuel-injection-control logic circuit. The fuel-injection-control logic circuit then sets the fuel-injection timing and fuel-injection pulse-width according to the calculated values for them.

The air/fuel ratio is not required to satisfy the stoichiometric value over the entire engine operating range particularly for supercharged engines. It is desirable to suppress an excessive exhaust gas temperature increase at high-speed and high-load conditions by operating the engine at an air/fuel ratio richer than the stoichiometric value. It is also desirable to save fuel consumption by operating the engine at an air/fuel ratio leaner than the stoichiometric value. For example, Japanese Patent Kokai No. 60-19939 discloses a fuel delivery control apparatus for resuming a closed loop control to adjust the air/fuel ratio at the stoichiometric value after operating the engine at a lean air/fuel ratio for a predetermined period of time or when the catalytic converter temperature exceeds a predetermined value. With such a conventional fuel delivery control, however, the air/fuel ratio is retained on its rich side at high-speed and high-load conditions even though the exhaust temperature does not increase to a sufficient extent, for example, during transient conditions. This results in poor fuel economy and increased emission of CO and HC pollutants.

Japanese Patent Kokai No. 61-55340 discloses a fuel delivery control apparatus arranged to retain the air/fuel ratio at an economy value at high-speed and high-load conditions as long as the exhaust gas temperature is below a predetermined value. However, this fuel delivery control cannot retain the engine output torque at a target value.

SUMMARY OF THE INVENTION

Therefore, it is a main object of the invention to provide an improved engine control apparatus which can provide good fuel economy, minimize pollutant emissions and retain engine output torque at high-speed and high-load conditions.

There is provided, in accordance with the invention, a control apparatus for controlling the air/fuel ratio of an air-fuel mixture supplied to an internal combustion engine and the timing of the sparks supplied to the engine in response to engine operating conditions. The apparatus comprises sensor means sensitive to exhaust gas temperature for producing a signal indicative of a sensed exhaust gas temperature, and a control unit coupled to the sensor means. The control unit includes means for producing a first signal when the engine is operating at high-speed and high-load conditions and a second signal when the engine is operating at the other conditions, means responsive to a change from the second signal to the first signal for setting the air/fuel ratio at a value and the spark timing at a value providing a uniform engine output torque, and means for changing the air/fuel ratio to a richer value and the spark timing to a value retaining the uniform engine output torque for the changed air/fuel ratio value each time the sensed exhaust gas temperature exceeds a target value.

BRIEF DESCRIPTION OF THE DRAWINGS

The invention will be described in greater detail by reference to the following description taken in connection with the accompanying drawings, in which.

DETAILED DESCRIPTION OF THE INVENTION

Figure 1:
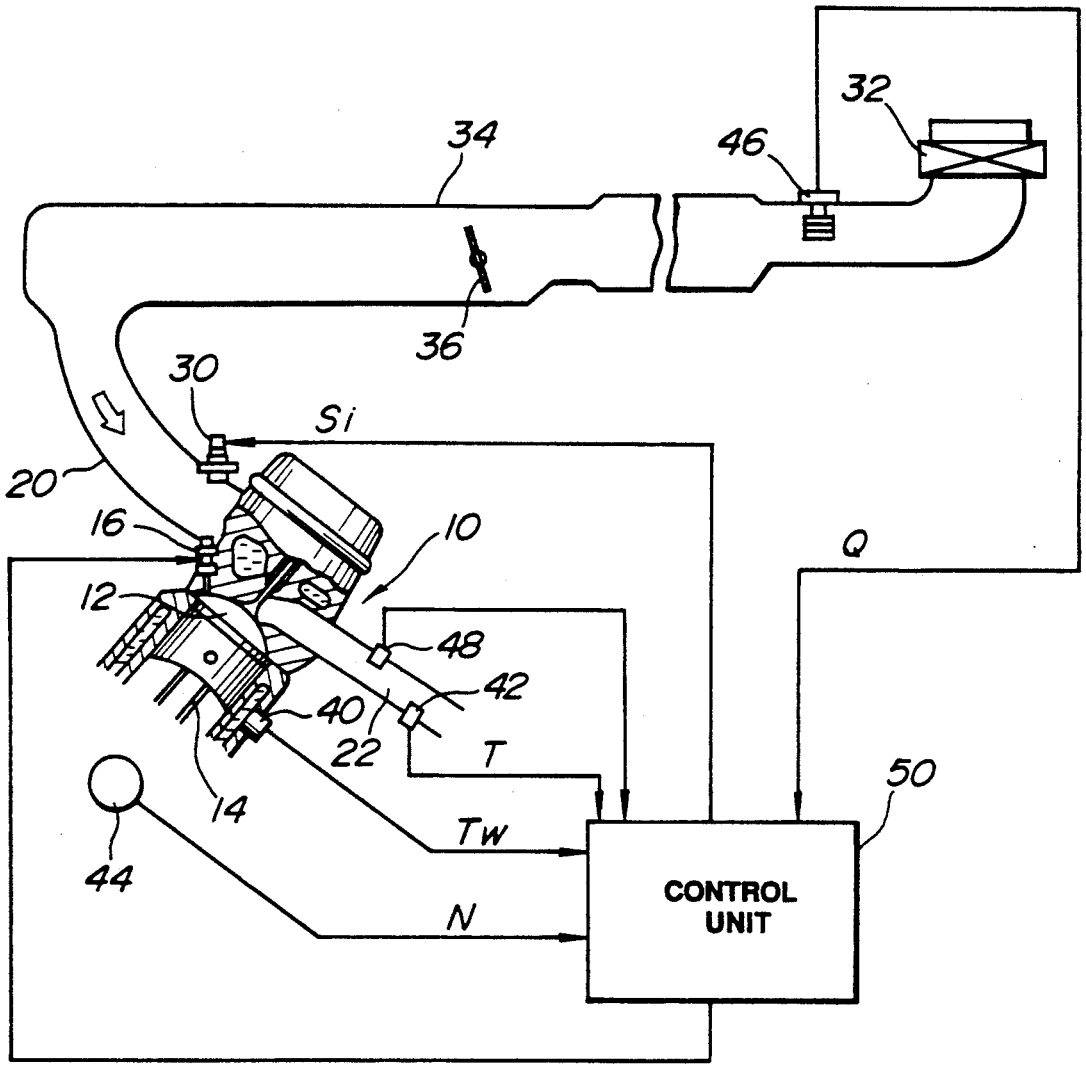
FIG. 1 is a schematic diagram of an engine control apparatus embodying the invention.

With reference to the drawings, and in particular to FIG. 1, there is shown a schematic diagram of an engine control apparatus embodying the invention. An internal combustion engine, generally designated by the numeral 10, for an automotive vehicle includes combustion chambers or cylinders, one of which is shown at 12. A piston 14 is mounted for reciprocal motion within the cylinder 12. A crankshaft (not shown) is supported for rotation within the engine 10 in response to reciprocation of the piston 14 within the cylinder 12.

An intake manifold 20 is connected with the cylinder 12 through an intake port with which an intake valve (not shown) is in cooperation for regulating the entry of combustion ingredients into the cylinder 12 from the intake manifold 20. A spark plug 16 is mounted in the top of the cylinder 12 for igniting the combustion ingredients within the cylinder 12 when the spark plug 16 is energized by the presence of high voltage electrical energy. An exhaust manifold 22 is connected with the cylinder 12 through an exhaust port with which an exhaust valve 18 is in cooperation for regulating the exit of combustion products, exhaust gases, from the cylinder 12 into the exhaust manifold 22. The intake and exhaust valves are driven through a suitable linkage with the crankshaft.

A fuel injector 30 is mounted for injecting fuel into the intake manifold 20 toward the intake valve. The fuel injector 30 opens to inject fuel into the intake manifold 12 when it is energized by the presence of electrical signal Si. The length of the electrical pulse, that is, the pulse-width, applied to the fuel injector 30 determines the length of time the fuel injector 30 opens and, thus, determines the amount of fuel injected into the intake manifold 20.

Air to the engine 10 is supplied through an air cleaner 32 into an induction passage 34. The amount of air permitted to enter the combustion chamber 12 through the intake manifold 20 is controlled by a butterfly throttle valve 36 located within the induction passage 34. The throttle valve 36 is connected by a mechanical linkage to an accelerator pedal (not shown). The degree to which the accelerator pedal is depressed controls the degree of rotation of the throttle valve 36. The accelerator pedal is manually controlled by the operator of the engine control system. In the operation of the engine 10, the exhaust gases are discharged into the exhaust manifold 22 and hence to the atmosphere through a conventional exhaust system.

The amount of fuel metered to the engine, this being determined by the width of the electrical pulses Si applied to the fuel injector 30 is repetitively determined from calculations performed by a digital computer, these calculations being based upon various conditions of the engine that are sensed during its operation. These sensed conditions include engine coolant temperature Tw, exhaust gas temperature T, engine speed N, intake air flow Q, and exhaust oxygen content. Thus, a engine coolant temperature sensor 40, an exhaust gas temperature sensor 42, a crankshaft position sensor 44, a flow meter 46, and an air/fuel ratio sensor 48 are connected to a control unit 50.

The engine coolant temperature sensor 40 is mounted in the engine cooling system and comprises a thermistor connected to an electrical circuit capable of producing a coolant temperature signal in the form of a DC voltage having a variable level proportional to coolant temperature. The exhaust gas temperature sensor 42 is located to sense exhaust gas temperature and it produces an exhaust gas temperature signal in the form of a DC voltage having a variable level proportional to exhaust gas temperature. The crankshaft position sensor 44 is provided for producing a series of crankshaft position electrical pulses, each corresponding to two degrees of rotation of the engine crankshaft, of a repetitive rate directly proportional to engine speed and a predetermined number of degrees before the top dead center position of each engine piston. The flow meter 46 is responsive to the air flow through the induction passage 34 and it produces an intake airflow signal proportional thereto.

The air/fuel ratio sensor 48 is provided to probe the exhaust gases discharged from the cylinders 12 and it is effective to produce a signal indicative of the air/fuel ratio at which the engine is operating. For example, the air/fuel ratio sensor 48 may be a device disclosed in greater detail in U.S. Pat. Nos. 4,776,943 and 4,658,790 assigned to the assignee of this invention and which are hereby incorporated by reference.

Figure 2:
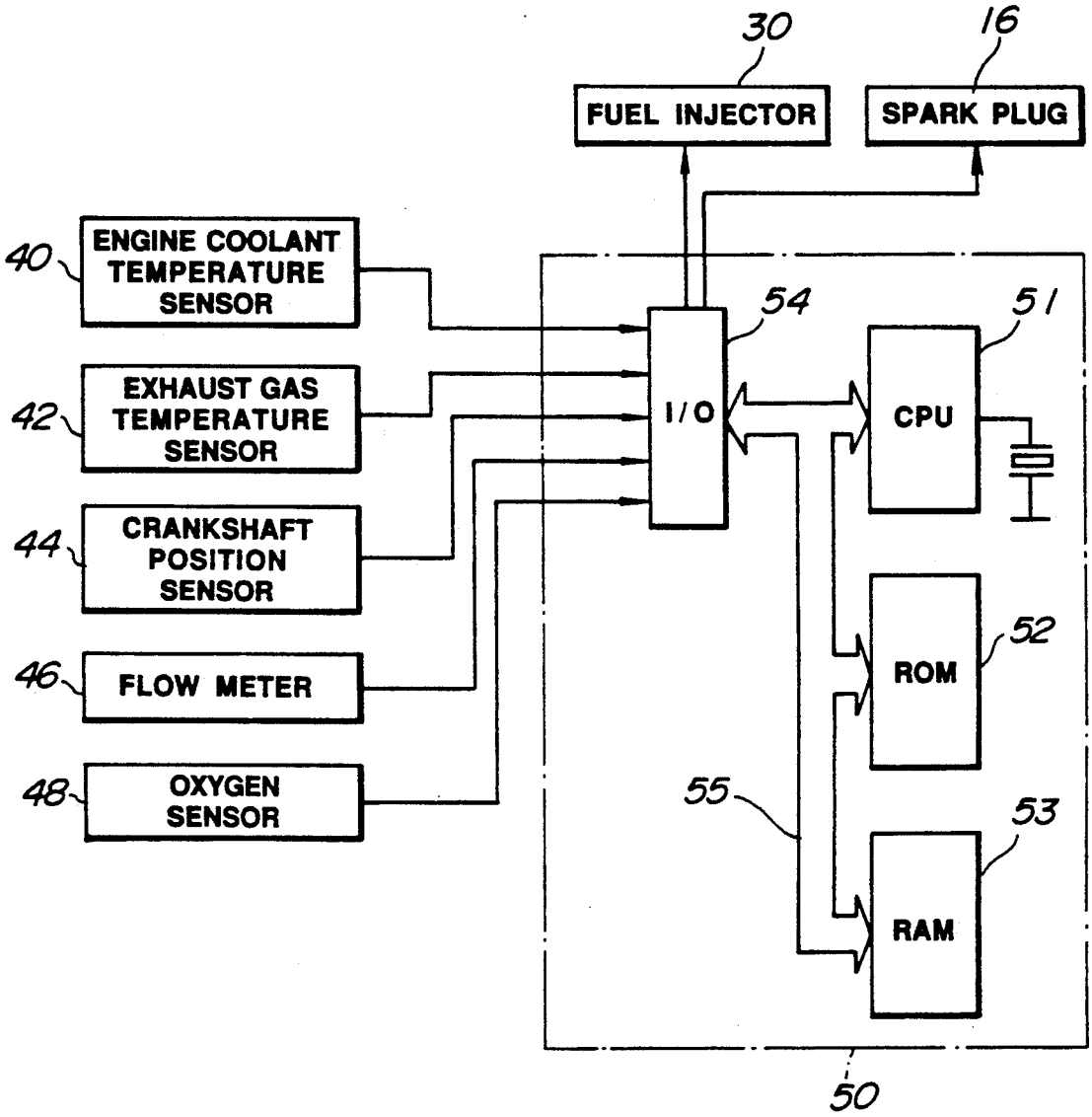
FIG. 2 is a schematic block diagram of the control unit used in the engine control apparatus of FIG. 1.

Referring to FIG. 2, the control unit 50 comprises a digital computer which includes a central processing unit (CPU) 51, a read only memory (ROM) 52, a random access memory (RAM) 53, and an input/output control unit (I/O) 54. The central processing unit 51 communicates with the rest of the computer via data bus 55. The input/output control unit 54 includes an analog-to-digital converter which receives analog signals from the flow meter and other sensors and converts them into digital form for application to the central processing unit 51 which selects the input channel to be converted. The read only memory 52 contains programs for operating the central processing unit 51 and further contains appropriate data in look-up tables used in calculating appropriate values for fuel delivery requirement and ignition system spark timing. The central processing unit 51 is programmed in a known manner to interpolate between the data at different entry points.

The central processing unit 51 calculates the fuel delivery requirement in the form of fuel-injection pulse-width. For this purpose, a basic value Tp for fuel-injection pulse-width is calculated as $$Tp = k \times Q/N$$

where k is a constant, Q is the intake air flow and N is the engine speed. The calculated fuel-injection pulse-width basic value Tp is then corrected for various engine operating parameters. The corrected fuel-injection pulse-width value Ti is given as $$Ti = Tp \times COEF \times ALPHA + Ts$$

where ALPHA is a correction factor related to the oxygen content of the exhaust gases for providing a closed loop air/fuel ratio control, Ts is a correction factor related to the voltage of the car battery, and COEF is a correction factor given as $$COEF = 1 + KTW + KMR + KAS + KAI + KFUEL$$

where KTW is a correction factor decreasing as the engine coolant temperature increases, and KMR is a correction factor for providing fuel enrichment control under high engine load conditions. The correction factor KMR is greater at a hevier engine load or at a higher engine speed. KAS is a correction factor for providing fuel enrichment control when the engine is cranking, KAI is a correction factor for providing fuel enrichment control when the engine is idling, and KFUEL is a correction factor for providing fuel enrichment control during acceleration.

Control words specifying desired fuel delivery requirements are periodically transferred by the central processing unit 51 to the fuel-injection control circuit included in the input/output control circuit 54. The fuel injection control circuit converts the received control word into a fuel injection pulse signal Si for application to a power transistor which connects the fuel injector 30 to the car battery for a time period calculated by the digital computer.

The central processing unit 51 also calculates desired values for ignition system spark timing. Control wards specifying desired spark timings are periodically transferred by the central processing unit 51 to the spark timing control circuit included in the input/output control circuit 54. The spark timing control circuit sets the spark timing by producing pulses to cause the ignition plug 16 to produce an ignition spark at the time calculated by the computer.

Figure 3:
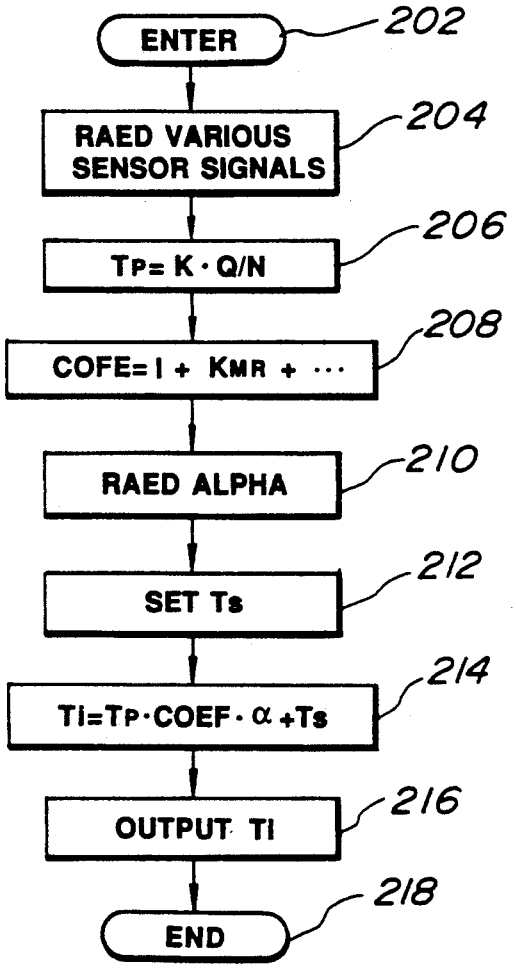
FIG. 3 is a flow diagram illustrating the programming of the digital computer used to calculate a desired value for fuel-injection pulse-width.

FIG. 3 is a flow diagram illustrating the programming of the digital computer as it is used to calculate a desired value for fuel delivery requirement in the form of fuel-injection pulse-width.

The computer program is entered at the point 202 at uniform intervals of time, for example, 10 msec. At the point 204 in the program, the various sensor signals are converted into digital form and read into the computer memory via the data bus 55. At the point 206 in the program, a basic value Tp for fuel-injection pulse-width is calculated by the central processing unit 51 from a relationship programmed into the computer. This relationship defines basic value Tp as $Tp=K\times Q/N$ where K is a constant, Q is the engine load, as inferred from measurement of intake air flow, and N is the engine speed. At the points 208, 210 and 212 in the program, the correction factors COEF, ALPHA and Ts are read into the random access memory 53.

At the point 214 in the program, the central processing unit 51 calculates an actual value Ti for fuel-injection pulse-width as $$Ti=Tp\times COEF\times ALPHA+Ts$$

At the point 216 in the program, the calculated actual value Ti for fuel-injection pulse-width is transferred via the data bus 55 to the fuel injection control circuit included in the input/output control unit 54. The fuel injection control circuit then sets the fuel-injection pulse-width according to the calculated value therefor. Following this, the program proceeds to the end point 218.

Figure 4:
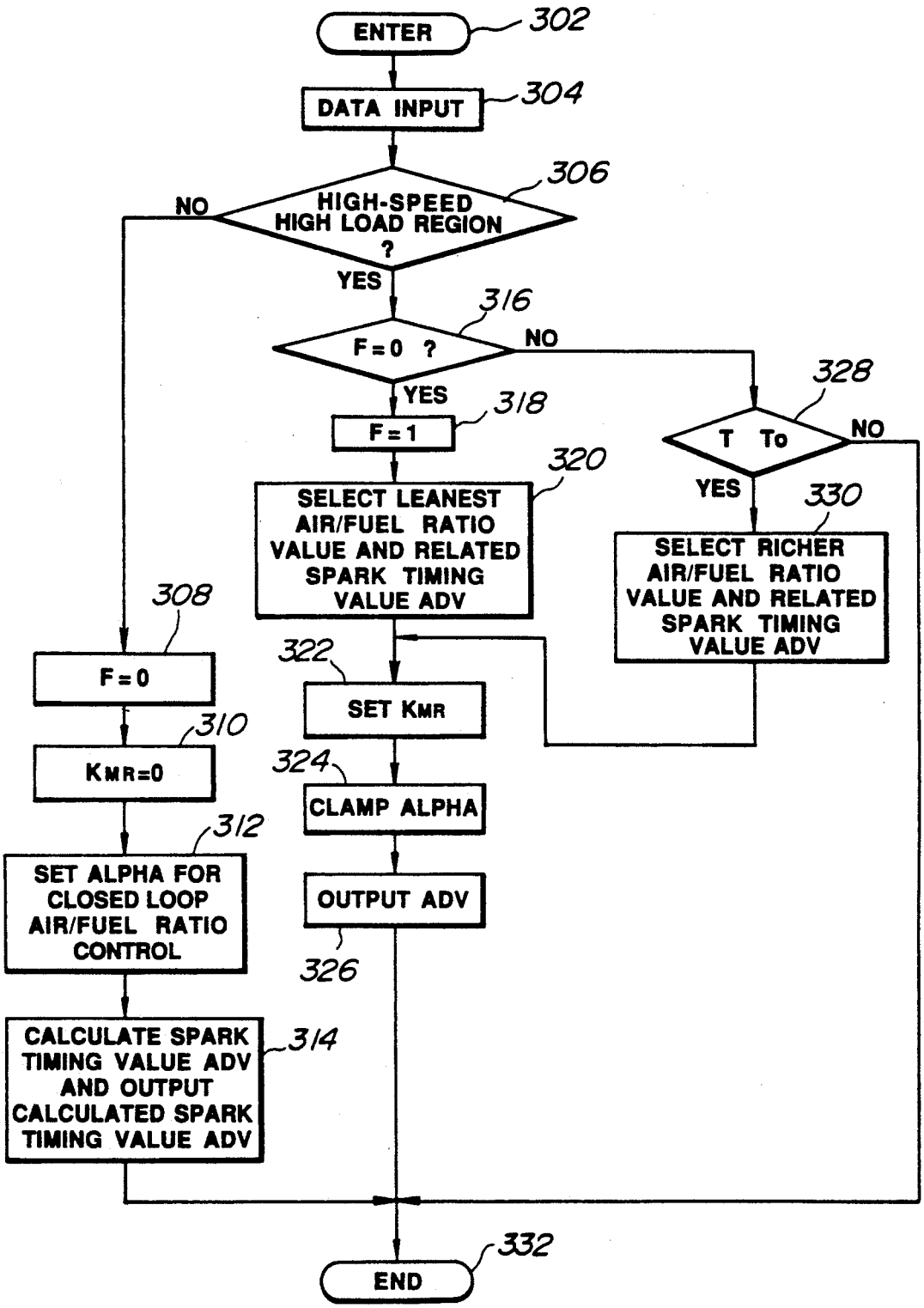
FIG. 4 is a flow diagram illustrating the programming of the digital computer used to calculate desired values for correction factors KMR and ALPHA and spark timing ADV.

FIG. 4 is a flow diagram illustrating the programming of the digital computer as it is used to calculate desired values for correction factors KMR and ALPHA and a desired value for ignition system spark timing ADV.

Figure 5:
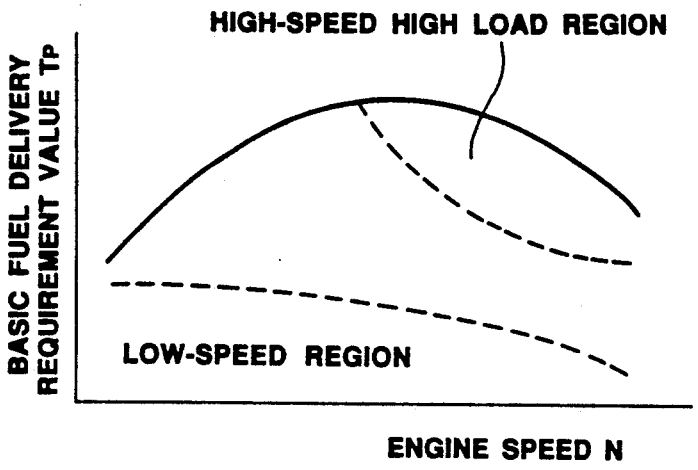
FIG. 5 is a graph used in explaining engine operating ranges.

The computer program is entered at the point 302. At the point 304 in the program, engine speed N, basic fuel delivery requirement value Tp and exhaust gas temperature T are read into the random access memory 53. The program then proceeds to a the point 306 where a determination is made as to whether or not the engine is operating at a high-speed, high-load condition. This determination is made with reference to the engine speed N and the basic fuel delivery requirement value Tp, as shown in FIG. 5. If the answer to this question is "yes", then the program proceeds to the point 316. Otherwise, it means that the engine is operating in an intermediate- or low-speed, intermediate- or low-load condition and the program proceeds to the point 308.

At the point 308 in the program, a flag is cleared to zero. The program then proceeds to the point 310 where the correction factor KMR is set at zero. At the point 312, the correction factor ALPHA is set based upon the signal from the air/fuel ratio sensor 48 to provide an air/fuel ratio feedback control so as to retain the air/fuel ratio at an optimum value. These calculated correction factors KMR and ALPHA are used in calculating an appropriate value Ti for fuel delivery requirement in the program of FIG. 3. Upon completion of the correction factor calculations, the program proceeds to the point 314 where an appropriate value for ignition system spark timing ADV is calculated from a relationship programmed into the computer. This relationship specifies the spark timing value ADV as a function of engine speed N and basic fuel delivery requirement value Tp. The calculated spark timing value is transferred by the central processing unit 51 to the spark timing control circuit. The spark timing control circuit sets the spark timing by producing pulses to cause the spark plug 16 to produce an ignition spark at the time calculated by the computer. Following this, the program proceeds to the end point 332.

At the point 316, in the program, a determination is made as to whether or not the flag is cleared. If the answer to this question is "yes", then it means that this cycle of execution of the program is the fast after the engine operation enters the high-speed and high-load region and the program proceeds to the point 318 where the flag is set at 1. Otherwise, the program proceeds to the point 328.

Figure 6:
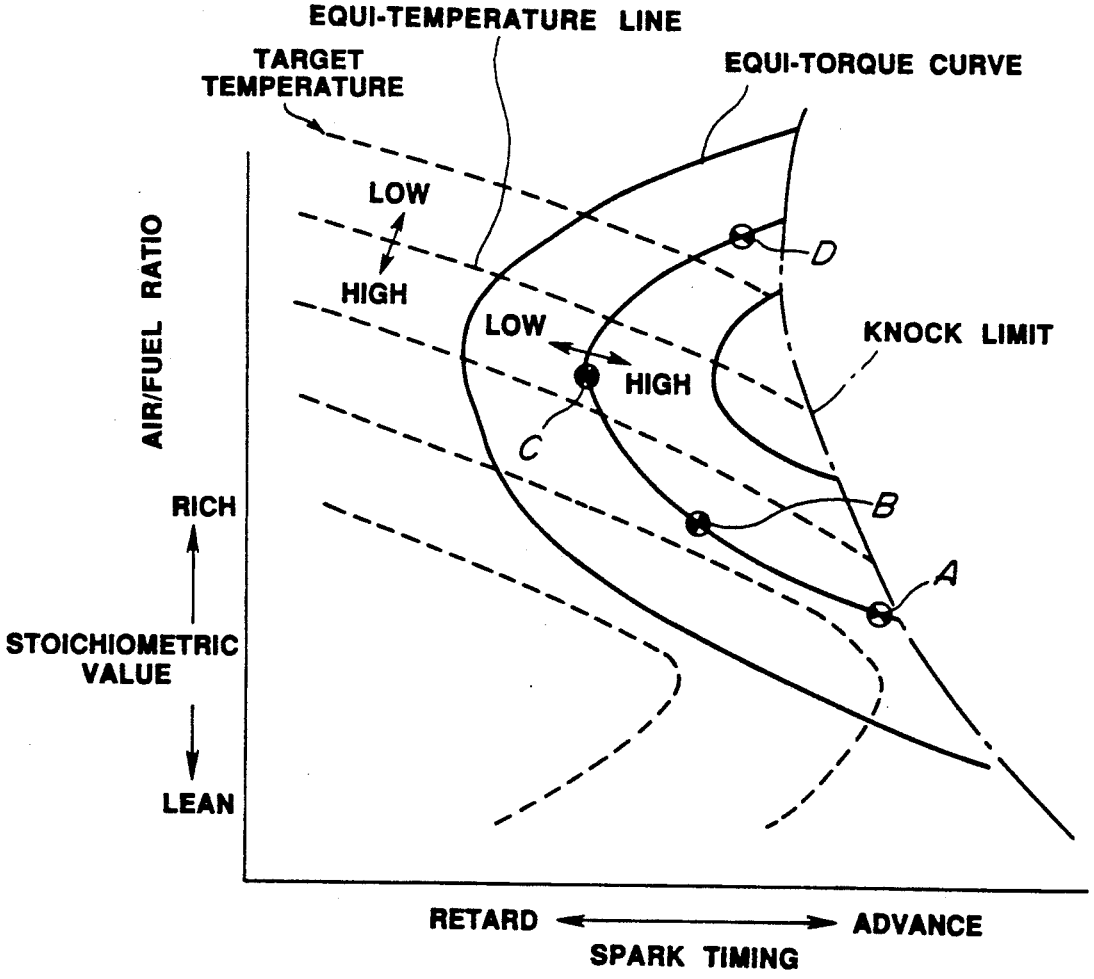
FIG. 6 is a graph used in explaining data programmed into the computer.

At the point 320 in the program, the central processing unit 51 selects a first, leanest air/fuel ratio value and a spark timing value predetermined to provide a uniform engine output torque for the leanest air/fuel ratio value. This selection is made from data programmed into the computer. The data include air/fuel ratio values and spark timing values preselected in relation to the respective air/fuel ratio values to provide a uniform engine output torque. In the illustrated case, these pairs are indicated by four points A, B, C and D laid on an equi-torque curve, as shown in FIG. 6. These points specify air/fuel ratio values and spark timing values selected to provide a uniform engine output torque for the respective air/fuel ratio values. The first point A specifies a first, leanest air/fuel-ratio and a spark-timing value selected to provide the uniform engine output torque for the first air/fuel ratio value. The second point B specifies a second air/fuel ratio value richer than the first air/fuel ratio valve and a second spark timing value selected to provide the uniform engine output torque for the second air/fuel ratio value. The third point C specifies a third air/fuel ratio value richer than the second air/fuel ratio value and a third spark timing value selected to provide the uniform engine output torque for the third air/fuel ratio value. The fourth point D specifies a fourth, richest air/fuel ratio value and a fourth spark timing value selected to provide the uniform engine output torque for the fourth air/fuel ratio value. As can be seen from FIG. 6, the exhaust gas temperature is at maximum near the stoichiometric air/fuel ratio and the engine output torque is at maximum on the rich side with respective to the stoichiometric air/fuel ratio.

At the point 332 in the program, the correction factor KMR is set at an appropriate value to provide the selected air/fuel ratio. At the point 324, the correction factor ALPHA is clamped at 1 to interrupt the closed loop air/fuel ratio control. Upon completion of these settings, the program proceeds to the point 326 where the spark timing is set at the selected value. Following this, the program proceeds to the end point 332.

At the point 328 in the program, a determination is made as to whether or not the exhaust gas temperature T is equal to or greater than a target value To. The target exhaust gas temperature value To is a predetermined value corresponding to an acceptable maximum temperature of the exhaust parts including the exhaust valve, the exhaust manifold wall, the turbine housing wall, etc. If the answer to this question is "yes", then the program proceeds to the point 330 where the central processing unit 51 selects a richer air/fuel ratio value and a spark timing value predetermined to provide the uniform engine output torque for the selected richer air/fuel ratio value. Following this, the program proceeds to the point 322.

If the exhaust gas temperature T is less than the target value To, then the program proceeds from the point 328 to the end point 332.

According to the invention, the air/fuel ratio of the air-fuel mixture supplied to the engine and the ignition system spark timing are controlled in a current manner when the engine is operating in a low-or intermediate-speed and low- or intermediate-load condition. At high-speed and high-load conditions, the air/fuel ratio is controlled to increase the air/fuel ratio (gradually) each time the exhaust gas temperature T exceeds a target value To. The air/fuel ratio is retained as it stands as long as the exhaust gas temperature T is less than the target value To.

According to the invention, the air/fuel ratio of an air-fuel mixture supplied to the engine is changed to a richer value each time the exhaust gas temperature exceeds a target value while the engine is operating at high-speed and high-load conditions. During the air/fuel ratio control, a uniform engine output torque is retained by changing the timing of the sparks supplied to the engine in relation to the changed air/fuel ratio. It is, therefore, possible to prevent an excessive exhaust gas temperature increase and provide improved fuel economy while maintaining the engine output torque at a uniform value. It is also possible to minimize emissions of CO and HC pollutants since the duration during which the engine is operating at a lean air/fuel ratio increases.

What is claimed is:

1. A control apparatus for controlling the air/fuel ratio of an air-fuel mixture supplied to an internal combustion engine and the timing of the sparks supplied to the engine in response to engine operating conditions, comprising:

sensor means sensitive to exhaust gas temperature for producing a signal indicative of a sensed exhaust gas temperature;

a memory for storing data including air/fuel ratio values and spark timing values preselected in relation to the respective air/fuel ratio values to provide a uniform engine output torque;

means for detecting a first signal when the engine is operating at high-speed and high-load conditions and a second signal when the engine is operating at the other conditions;

means responsive to a change from the second signal to the first signal for selecting a leanest one of the air/fuel ratio values and a spark timing value related to the leanest air/fuel ratio;

means for selecting a richer air/fuel ratio value and a spark timing value related to the selected richer air/fuel ratio value each time the sensed exhaust gas temperature exceeds a predetermined value in the presence of the first signal; and means for controlling the air/fuel ratio at the selected value and the spark timing at the selected value to provide the uniform engine output torque.

* * * * *